US010074912B2

(12) United States Patent
Schmutzler et al.

(10) Patent No.: US 10,074,912 B2
(45) Date of Patent: Sep. 11, 2018

(54) DIN CONNECTOR END CAP

(71) Applicant: CommScope Technologies LLC, Hickory, NC (US)

(72) Inventors: Steven Lee Schmutzler, Homer Glen, IL (US); Troy Inslee Vanderhoof, Plano, TX (US)

(73) Assignee: CommScope Technologies LLC, Hickory, NC (US)

( * ) Notice: Subject to any disclaimer, the term of this patent is extended or adjusted under 35 U.S.C. 154(b) by 187 days.

(21) Appl. No.: 14/945,996

(22) Filed: Nov. 19, 2015

(65) Prior Publication Data

US 2016/0308286 A1 Oct. 20, 2016

Related U.S. Application Data

(60) Provisional application No. 62/148,436, filed on Apr. 16, 2015.

(51) Int. Cl.
*H01R 13/518* (2006.01)
*H01Q 21/28* (2006.01)
(Continued)

(52) U.S. Cl.
CPC ..... *H01Q 21/28* (2013.01); *H01Q 1/42* (2013.01); *H01R 13/639* (2013.01);
(Continued)

(58) Field of Classification Search
CPC .. H01R 13/6585; H01R 9/2416; H01R 12/58; H01R 13/115; H01R 13/405; H01R 13/465; H01R 13/501; H01R 13/5841; H01R 13/6272; H01R 13/6273; H01R 13/6461; H01R 13/6471; H01R 13/6583; H01R 13/6593
See application file for complete search history.

(56) References Cited

U.S. PATENT DOCUMENTS 4,812,133 A * 3/1989 Fleak ..... H01R 13/6315 248/27.3
5,059,139 A 10/1991 Spinner
(Continued)

FOREIGN PATENT DOCUMENTS

KR 20-1998-0028090 8/1998

OTHER PUBLICATIONS

International Search Report and Written Opinion for corresponding PCT Application No. PCT/US2015/061757, dated Mar. 15, 2016, 13 pages.

(Continued)

*Primary Examiner* — Truc Nguyen
(74) *Attorney, Agent, or Firm* — Myers Bigel, P.A.

(57) ABSTRACT

Aspects of the present disclosure may be directed to an end cap of a base station antenna for securing cable connectors to the end cap. The end cap may include a plurality of retaining assemblies formed integrally with the cap, and are dimensioned to retain a respective plurality of cable connectors to the end cap. The end cap may be capable of supporting numerous antenna models and configurations. The end cap may include molded features allowing for DIN connectors for various antenna models to be snapped into the end cap, without the use of other hardware and formed end bracket assemblies.

3 Claims, 6 Drawing Sheets

(51) Int. Cl.

| | |
|---|---|
| ***H01Q 1/42*** | (2006.01) |
| ***H01R 13/639*** | (2006.01) |
| ***H01R 13/74*** | (2006.01) |
| ***H01R 24/52*** | (2011.01) |
| *H01R 103/00* | (2006.01) |
| *H01Q 1/24* | (2006.01) |

(52) U.S. Cl.
CPC ..... *H01R 13/741* (2013.01); *H01R 24/52* (2013.01); *H01Q 1/246* (2013.01); *H01R 13/518* (2013.01); *H01R 2103/00* (2013.01); *H01R 2201/02* (2013.01)

(56) References Cited

U.S. PATENT DOCUMENTS

| | | | | |
|---|---|---|---|---|
| 6,411,526 | B1 * | 6/2002 | Nguyen | H01R 13/518 220/4.02 |
| 8,876,551 | B2 * | 11/2014 | Berger | H01R 24/52 439/579 |
| 2008/0233795 | A1 | 9/2008 | Kucera et al. | |
| 2009/0060421 | A1 | 3/2009 | Parikh et al. | |
| 2014/0134878 | A1 | 5/2014 | Van Swearingen et al. | |

OTHER PUBLICATIONS

International Preliminary Report on Patentability and the Written Opinion of the International Searching Authority corresponding to International Patent Application No. PCT/US2015/061757 (7 pages) (dated Oct. 26, 2017).

* cited by examiner

DIN CONNECTOR END CAP

CROSS-REFERENCE TO RELATED APPLICATIONS

This application claims the benefit of U.S. Provisional Patent Application No. 62/148,436, filed on Apr. 16, 2015, the entire contents of which are incorporated herein by reference in their entirety.

BACKGROUND

Various aspects of the present disclosure relate to antennae, and, more particularly, to apparatus for securing a DIN connector to an end cap to an antenna.

Currently, there exists many antenna types, shapes, and sizes. An end cap of an antenna may snap onto a radome to seal and protect the antenna from adverse environmental conditions. The end cap may have a plurality of Deutsches Institut für Normung (or "DIN") connectors attached thereto, to electrically connect other components (e.g., dipoles) of the antenna with an external device such as a receiver or transmitter. Due to the wide variation of antennae and antenna configurations, brackets, end caps, and other hardware may need to be customized for each antenna configuration, at least for securing DIN connectors to the end cap for connection to other components. Design and implementation of this additional hardware may be burdensome and costly.

As such, it would be desirable to have an end cap capable of supporting numerous antenna configurations and securing DIN connectors without the use of additional hardware.

BRIEF DESCRIPTION OF THE SEVERAL VIEWS OF THE DRAWINGS

The following detailed description will be better understood when read in conjunction with the appended drawings. For the purpose of illustration, there are shown in the drawings, various embodiments. It should be understood, however, that the disclosure is not limited to the precise arrangements and instrumentalities shown.

In the drawings.

DETAILED DESCRIPTION OF VARIOUS EMBODIMENTS

Figure 1:
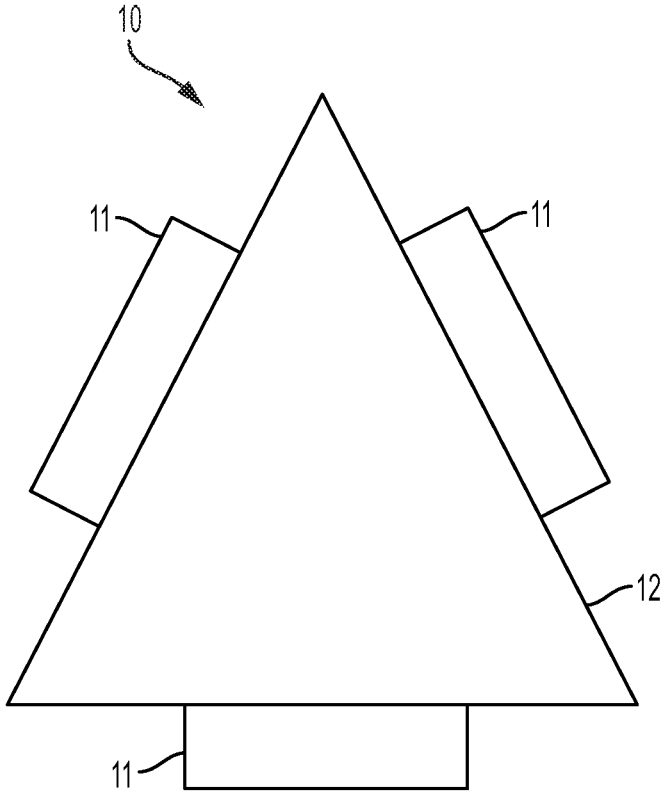
FIG. 1 is a plan view of a cell site having antennae, according to an aspect of the present disclosure.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

FIG. 1 is a plan view of a cell site having antennae (e.g., base station antennae or other antenna types). The cell site 10 generally comprises a triangular platform 12 which may be mounted atop an antenna tower (not shown), or other suitable structure, such as a building (not shown). The platform includes a first side, a second side, and a third side, each of which have an antenna 11.

The antenna 11 may be housed by an enclosure such as a radome (not shown). An end cap (shown in FIGS. 2-7) may snap onto the radome to seal and protect the antenna from adverse environmental conditions. The end cap may have a plurality of DIN connectors attached thereto, to electrically connect other components (e.g., dipole elements) of the antenna with an external device such as a receiver or transmitter. For example, the connector may couple a cable (e.g., a coaxial cable or other type), which may be connected to one or more components external to the antenna 11, to another cable or line (e.g., a coaxial cable or other type), which may also be connected to one or more components internal to the antenna 11 (e.g., drive shaft, phase shifter(s), and the like). In light of the specification, one of ordinary skill in the art would understand that other types of cable connectors may be used in keeping with the spirit of the disclosure.

Due at least in part to the large variation of antenna types, shapes, and sizes, implementation can be burdensome and costly. For example, at least because of different antenna configurations, brackets, end caps, and other hardware may need to be customized (e.g., specifically manufactured) for each antenna configuration. Aspects of the present disclosure may include an end cap capable of supporting numerous antenna models and configurations. The end cap may include molded features that may allow for DIN connectors for various antenna models to be snapped into the end cap, without the use of other hardware and formed end bracket assemblies. Consequently, assembly time may be reduced, and passive intermodulation (PIM) attributed to the use of additional hardware may be reduced or otherwise eliminated.

Figure 2:
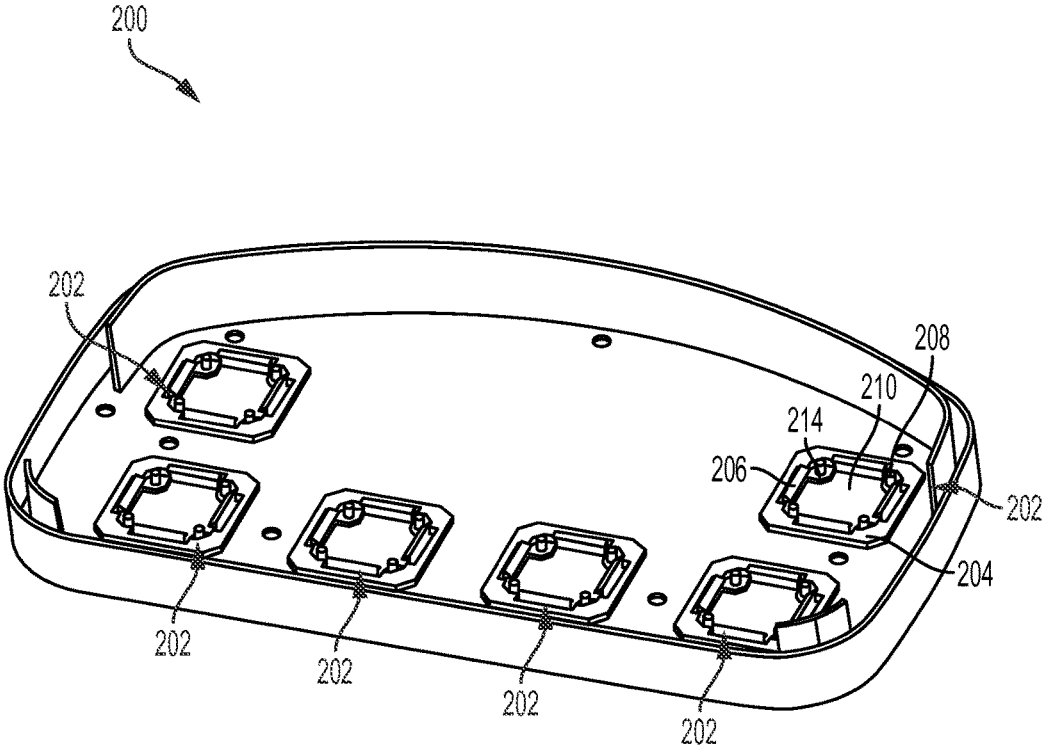
FIG. 2 is a perspective view of an inside of an end cap of one of the antennae, according to an aspect of the present disclosure.
Figure 3:
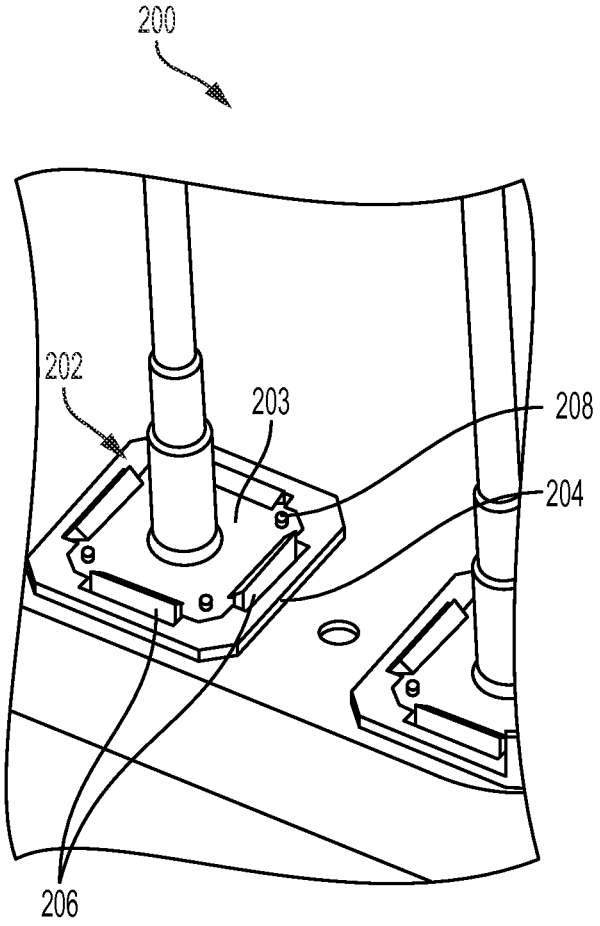
FIG. 3 is an enlarged view of the inside of the end cap with a DIN connector retained therein, according to an aspect of the present disclosure.

FIGS. 2 and 3 are views of the inside of an end cap according to aspects of the present disclosure. The inside may refer to the side of the end cap facing the antenna 11. As shown, the end cap 200 may include a plurality of retaining assemblies 202 attached thereto or molded therein.

As best seen in FIG. 3, each of the retaining assemblies 202 may be configured to secure a DIN connector 203 to the end cap 200. Each of the retaining assemblies 202 may include an anti-rotation flange 204, one or more retention tabs 206, and one or more alignment posts 208. The anti-rotation flange 204 may be generally rectangular in shape, and may have an exterior portion and an interior portion that defines an opening 210 for receiving a DIN connector 203. The shape of the anti-rotation flange may prevent the DIN connector 203 from rotating during and after attachment of the DIN connector 203 to the retainer assembly 202.

Each of the retention tabs 206 may be positioned on a respective side of the interior portion of the anti-rotation flange 204. Each of the retention tabs 206 may be configured to have an inward biasing force towards the opening 210 of the respective retaining assembly 202. As such, upon a force on the retention tab 206 in a direction opposite the biasing force, the DIN connector 203 may be inserted through the opening 210 of the respective retaining assembly 202.

Once fully inserted through the opening, the retention tab 206 may return to its original position, and because of the inward biasing force, the retention tab may at least partially overlap a portion of the mounting tab of the DIN connector 203, aiding in the retention of the DIN connector 203 to the end cap 200.

Positioned in respective corners of the interior portion, between each of the retention tabs 206, may be alignment posts 208. Each of the alignment posts 208 may extend from an alignment member 214 that may be attached to, or be a part of, a respective corner of the interior portion. Each of the alignment posts 208 may extend in a direction transverse to the plane defined by the end cap 200, and may be configured to engage holes in a mounting bracket of the DIN connector 203 and aid in the proper alignment of the DIN connector 203 to the end cap 200.

Figure 4:
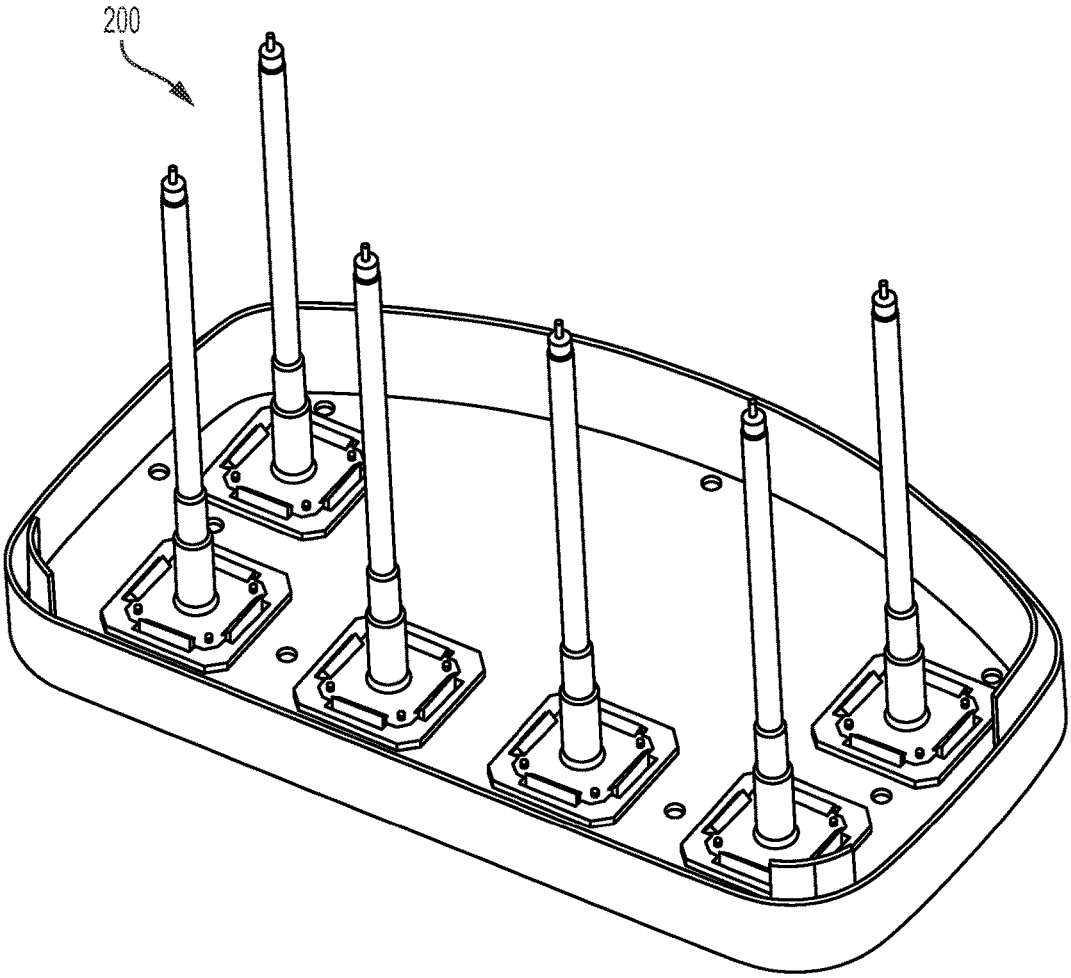
FIG. 4 is a perspective view of the inside of the end cap with each of the retaining assemblies of the end cap having a DIN connector secured thereto, according to an aspect of the present disclosure.

FIG. 4 is an inside view of the end cap 200 after each of the desired DIN connectors 203 is secured thereto. As shown, each of the openings 210 of the end cap 200 may be filled with a DIN connector 203. However, such a configuration is by way of non-limiting example only. For example, as discussed above, the end cap 200 may be used with various different antenna configurations, some of which may employ fewer DIN connectors 203 than the number of existing openings 210 in the end cap 200. As such, any unused openings 203 may be filled with a filler panel (not shown), which may be snapped, or otherwise secured in place, to seal and protect the antenna from adverse environmental conditions.

Figure 6:
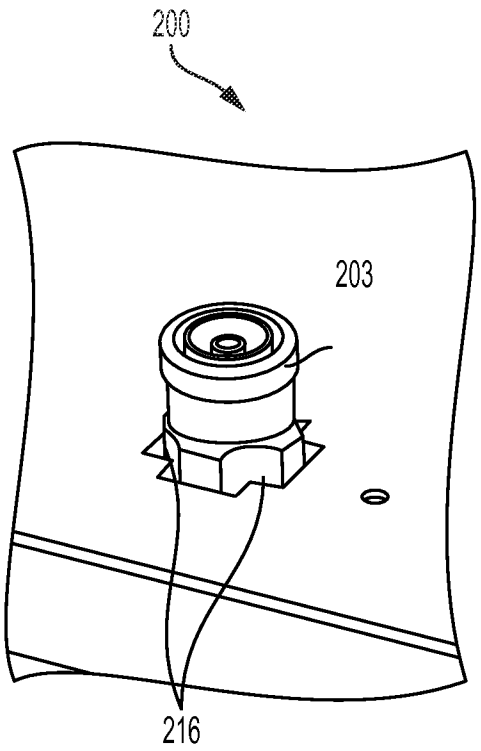
FIG. 6 is an enlarged view of the outside of the end cap with a DIN connector secured within a retaining assembly of the end cap, according to an aspect of the present disclosure.
Figure 5:
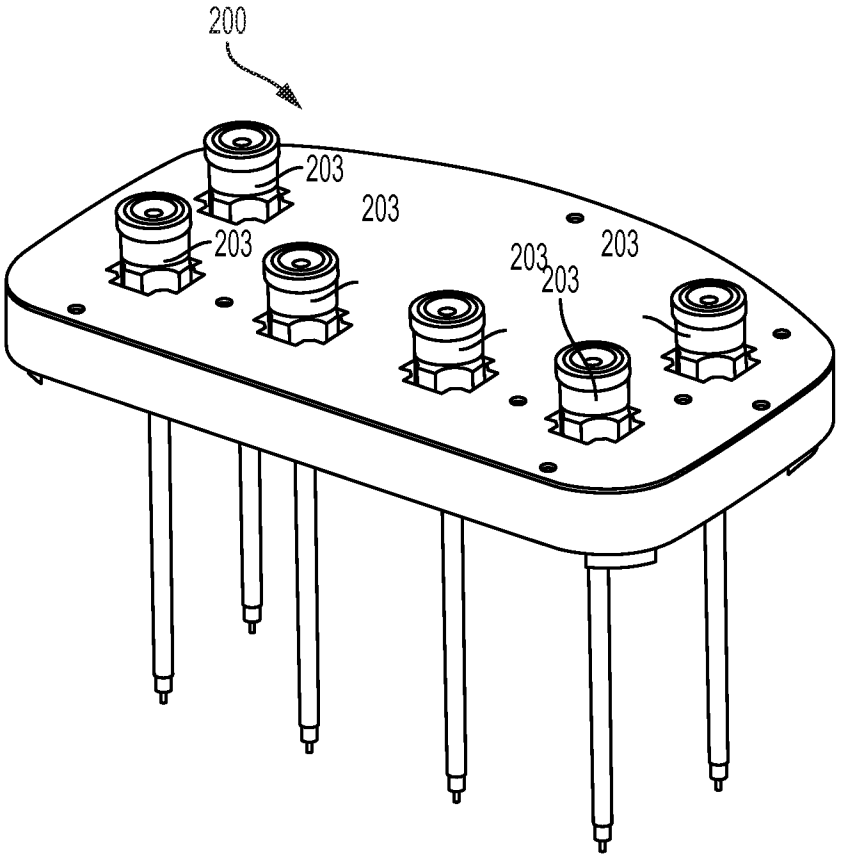
FIG. 5 is a perspective view of the outside of the end cap with each of the retaining assemblies of the end cap having a DIN connector secured thereto, according to an aspect of the present disclosure.

As shown in FIGS. 5 and 6, an example of an outside of the end cap 200 is shown with DIN connectors 203 connected thereto. The outside may refer to a side of the end cap 200 facing a direction opposite the antenna 11. As best seen in the exploded view in FIG. 6, the end cap 200 may be configured such that flats 216 of the DIN connector 203 may be exposed. Such exposure may aid in the installation of the DIN connector 203, as well as reduce a risk of twist out or damage to the end cap 200.

Figure 7:
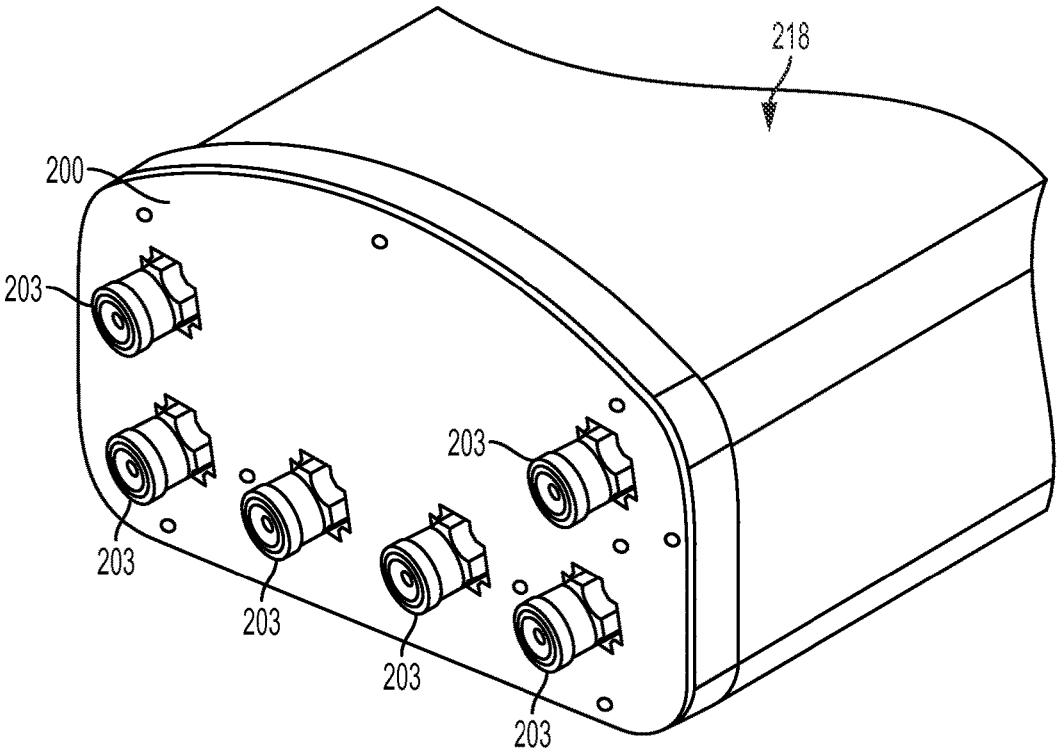
FIG. 7 is a perspective view of DIN connectors secured to the end cap attached to the antenna according to an aspect of the present disclosure.

After the desired DIN connectors 203 are secured to the end cap 200, the end cap 200 may be attached to a radome 218 of antenna 11, an outside view of which is shown in FIG. 7.

Various aspects of the present disclosure have now been discussed in detail; however, the disclosure should not be understood as being limited to these aspects. It should also be appreciated that various modifications, adaptations, and alternative embodiments thereof may be made within the scope and spirit of the present disclosure.

What is claimed is:

1. An end cap attachable to a radome of an antenna and configured to secure a cable connector to the antenna, the end cap comprising:

a plurality of retaining assemblies formed integrally with the end cap, each retaining assembly being dimensioned to retain a respective cable connector to the end cap, wherein each retaining assembly includes:

at least one anti-rotation flange having a polygonal interior portion that defines a cavity for receiving a portion of the respective cable connector;

at least one alignment post configured to engage a respective hole in a flange of the cable connector and extending in a direction transverse to a plane defined by the end cap; and at least one tab biased to overlap a portion of the respective cable connector upon reception through the cavity.

2. The end cap of claim 1, wherein the antenna includes a base station antenna.

3. The end cap of claim 1, wherein the end cap further includes a retaining assembly filled with a filler panel.

* * * * *